US007408273B2

(12) United States Patent
Slocum

(10) Patent No.: US 7,408,273 B2
(45) Date of Patent: Aug. 5, 2008

(54) SHORE POWER ACCESS SYSTEM

(76) Inventor: Kim M. Slocum, 35 EMS D3 La., Syracuse, IN (US) 46567

( * ) Notice: Subject to any disclaimer, the term of this patent is extended or adjusted under 35 U.S.C. 154(b) by 181 days.

(21) Appl. No.: 11/243,859

(22) Filed: Oct. 5, 2005

(65) Prior Publication Data

US 2006/0076835 A1 Apr. 13, 2006

Related U.S. Application Data

(60) Provisional application No. 60/617,808, filed on Oct. 12, 2004.

(51) Int. Cl.
*H02J 1/00* (2006.01)

(52) U.S. Cl. ..... 307/80

(58) Field of Classification Search ..... 307/80
See application file for complete search history.

(56) References Cited

U.S. PATENT DOCUMENTS 5,055,702 A 10/1991 Bhattacharya
5,245,219 A 9/1993 Romatzick, Jr. et al.
5,302,857 A 4/1994 Charles et al.
5,520,470 A * 5/1996 Willett ..... 400/88
6,166,525 A * 12/2000 Crook ..... 322/11
6,208,038 B1 * 3/2001 Campbell ..... 307/18
6,965,818 B2 * 11/2005 Koenig et al. ..... 701/36

* cited by examiner

*Primary Examiner*—Robert L. Deberadinis
(74) *Attorney, Agent, or Firm*—Tarolli, Sundheim, Covell & Tummino LLP

(57) ABSTRACT

A shore power access system (10) for directing shore power to a power distribution center (34) of a boat (12) includes at least two shore power inlets (30) mountable onboard the boat. The shore power inlets (30) are connectable with a source (40) of shore power located off-board the boat (12) to receive shore power from the off-board source. Actuatable switching devices (32) establish an electrical connection between one of the shore power inlets (30) and the boat power distribution center (34). The switching devices (32) are operatively connectable to the shore power inlets (30) and to the boat power distribution center (34). The switching devices (32) are actuatable manually or automatically.

16 Claims, 4 Drawing Sheets

SHORE POWER ACCESS SYSTEM

RELATED APPLICATIONS

This application claims the benefit of U.S. Provisional Application Ser. No. 60/617,808, filed on Oct. 12, 2004.

TECHNICAL FIELD

The present invention relates to a system for providing access to electrical shore power on a watercraft, such as a boat.

BACKGROUND

Boats and other watercraft often rely on external supplies of electrical power from shore, commonly referred to as "shore power," when docked or moored, for example, at a marina. Accessing shore power is desirable among boaters because it relieves the need to rely on the boat's generator or battery for onboard electrical power. This allows the boater to power onboard boat systems, such as bilge pumps, and enjoy onboard conveniences, such as appliances, lighting, entertainment systems, HVAC, and communication systems.

Shore power is typically delivered to the boat by one or more cables terminated with standard electrical connectors adapted to connect with mating shore power inlet connectors mounted on the boat. For example, at a dock, shore power cabling may be terminated with a plug having "female" electrical connectors. A shore power inlet mounted onboard the boat may include a receptacle for receiving and mating with the plug to guide the female electrical connectors of the plug onto "male" pins of the of the receptacle.

Boaters are commonly inconvenienced by a situation in which the shore power cabling is located distant, remote, or otherwise inconvenient in relation to the location of the shore power inlet on the boat. For example, if the boat is moored on its port side with its bow facing out, a shore power inlet located at mid-ship on the starboard side would necessitate running the shore power cabling on an inconvenient path, such as across the deck or bow, through the cockpit, or across the stern and along the starboard side.

SUMMARY

The present invention relates to a shore power access system for directing shore power to a power distribution center of a boat. The system includes at least two shore power inlets, mountable onboard the boat, that are connectable with a source of shore power located off-board the boat to receive shore power from the off-board source. Actuatable switching devices establish an electrical connection between one of the shore power inlets and the boat power distribution center. The switching devices are operatively connectable to the shore power inlets and to the boat power distribution center. The switching devices are actuatable manually or automatically.

The present invention also relates to a shore power access system. The system includes a first shore power inlet including a first hot wire, a first neutral wire, and a first ground wire. A second shore power inlet includes a second hot wire, a second neutral wire, and a second ground wire. A ground bus is electrically connected with the first ground wire and the second ground wire. A hot wire switching device is operatively connected with the first and second hot wires and a power distribution center of the boat. The hot wire switching device is actuatable to a first condition making a connection between the first hot wire and the boat power distribution center and breaking a connection between the second hot wire and the boat power distribution center. The hot wire switching device is actuatable to a second condition making the connection between the second hot wire and the boat power distribution center and breaking the connection between the first hot wire and the boat power distribution center. A neutral wire switching device is operatively connected with the first and second neutral wires and the boat power distribution center. The neutral wire switching device is actuatable to a first condition making a connection between the first neutral wire and the boat power distribution center and breaking a connection between the second neutral wire and the boat power distribution center. The neutral wire switching device is actuatable to a second condition making the connection between the second neutral wire and the boat power distribution center and breaking the connection between the first neutral wire and the boat power distribution center. An actuator actuates the hot wire switching device and the neutral wire switching device between their respective first and second conditions. The actuating device is configured to prevent one of the hot wire switching devices and the neutral wire switching devices from being actuated to the first condition while the other of the hot wire switching devices and the neutral wire switching devices devices is actuated to the second condition.

DRAWINGS

DESCRIPTION

Figure 1:
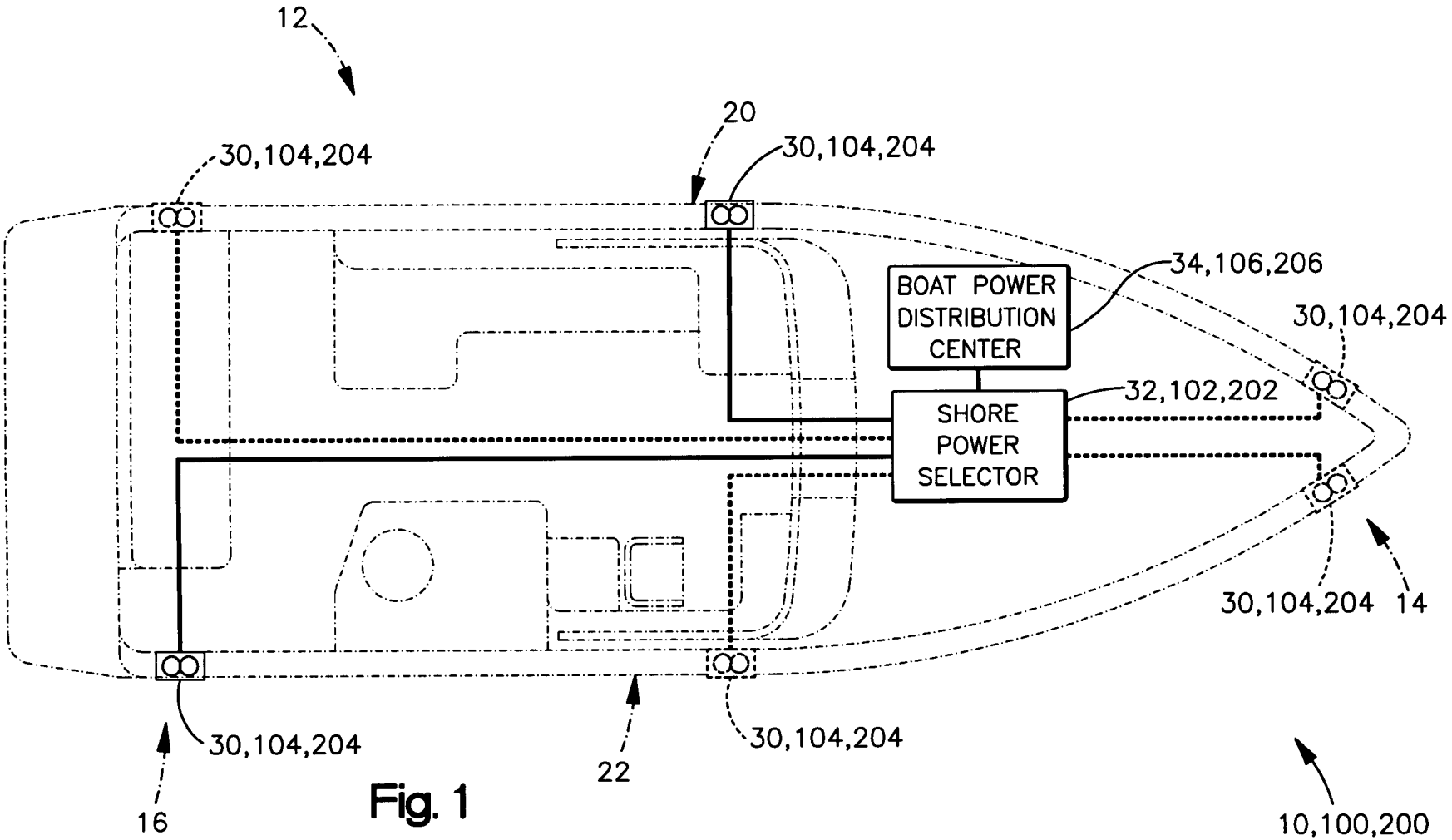
FIG. 1 is an overhead schematic view of a boat equipped with a shore power access system of the present invention.

Referring to FIG. 1, a shore power access system 10 is implemented in a watercraft 12, such as a boat. The boat 12 has a bow 14, a stem 16, a port side 20 and a starboard side 22. The shore power access system 10 includes a plurality of shore power inlets 30 mounted at any desired location onboard the boat 12. In the example embodiment illustrated in FIG. 1, the shore power access system 10 includes two shore power inlets 30, one at port side mid-ship and one at starboard side stem, which are illustrated in solid lines in FIG. 1. Alternative locations for the shore power inlets 30, shown in dashed lines in FIG. 1, include port side bow, starboard side bow, starboard side mid-ship, and port side stem. The shore power inlets 30 may have any of these alternative locations or other alternative locations (not shown). Also, the shore power access system 10 may include more than two shore power inlets 30.

The shore power access system 10 also includes a shore power selector 32 for directing shore power from the shore power inlets 30 to a power distribution center 34 of the boat 12. The power distribution center 34 may comprise any circuit or structure configured to provide or distribute power to the various electrical circuits or systems (not shown) of the boat 12. For example, the power distribution center 34 may comprise a fuse box or circuit breaker panel with hot, neutral, and ground busses for distributing power to various circuits of the boat. As another example, the power distribution center 34 may provide power directly to one or more electrical circuits of the boat 12.

According to the present invention, the shore power access system 10 is configured and adapted to direct shore power to the power distribution center 34 from the particular shore power inlet 30 to which shore power cabling (not shown in FIG. 1) is connected. The shore power access system 10 thus allows for accessing an off-board shore power source through the shore power inlet 30 located most conveniently relative to the shore power source, e.g., cabling, given the mooring position of the boat 12.

Figure 2:
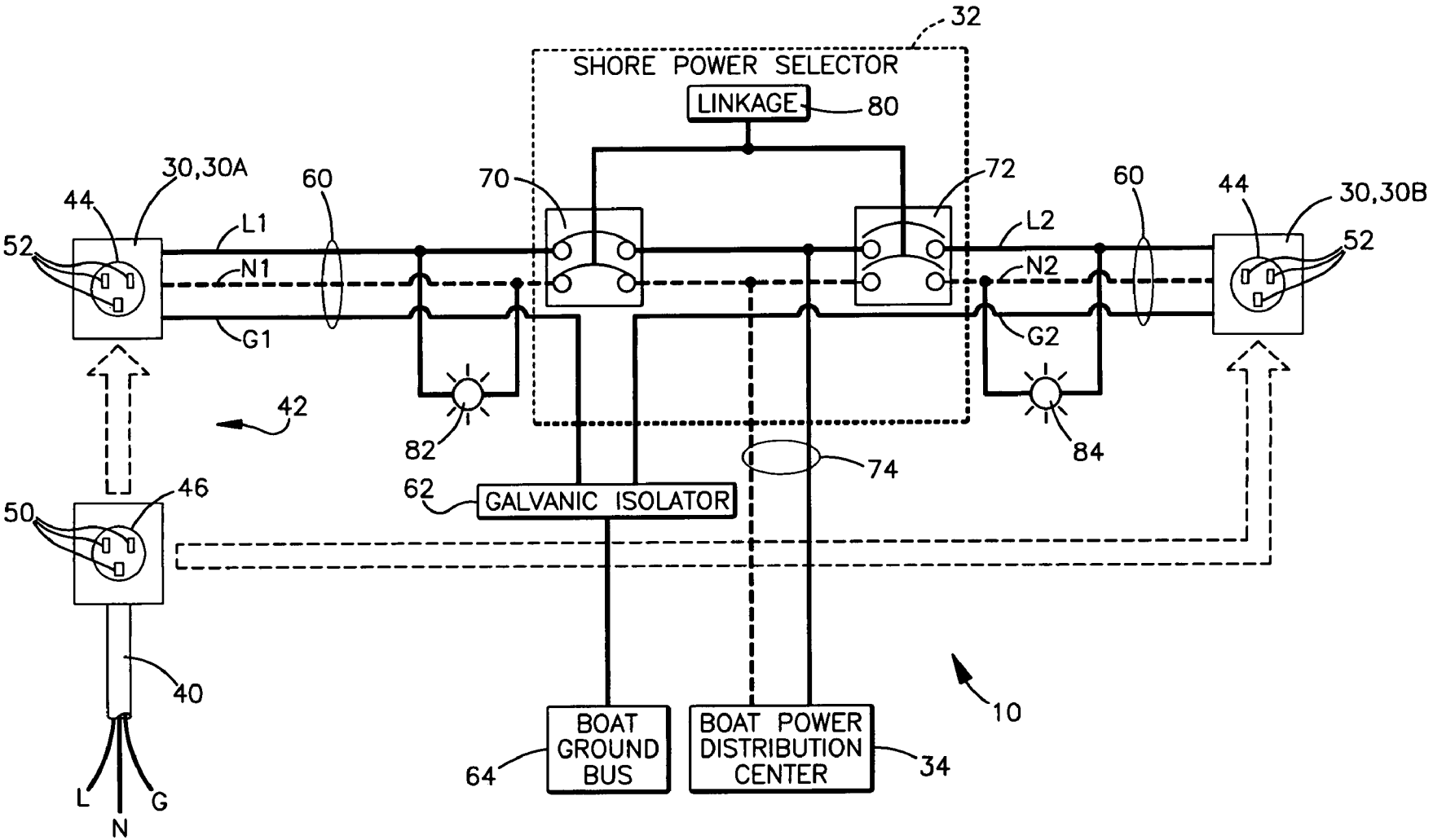
FIG. 2 is a schematic view of a shore power access system, according to a first example embodiment of the present invention.

FIG. 2 illustrates an example configuration of the shore power access system 10 in which shore power is distributed from an off-board shore power source 40, e.g., cabling, to the boat power distribution center 34 via manual operation of the shore power selector 32. The shore power access system 10 of FIG. 2 includes two shore power inlets 30 and thus may provide access to shore power at two different locations on the boat. To provide clarity in the description of the example embodiment of FIG. 2, first and second shore power inlets 30 are identified, respectively, at 30A and 30B.

As shown schematically in FIG. 2, the shore power inlets 30 and shore power source 40 may be fit with electrical connectors 42 configured and adapted to provide an electrical connection between the shore cabling and the shore power inlets. For example, as shown in FIG. 2, the electrical connectors 42 may comprise receptacles 44 associated with the shore power inlets 30 and plugs 46 associated with the shore power source 40. The receptacles 44 are configured and adapted to receive and mate with the plugs 46. In this configuration, the electrical connectors 42 may be configured and adapted to guide "female" connectors or contacts 50 of the plugs 46 onto "male" connectors or pins 52 of the receptacle 44.

The shore power inlets 30 are electrically connected to the shore power selector 32 by conductors 60, such as wires or cabling. In the example embodiment illustrated in FIG. 2, the conductors 60 connecting the shore power inlets 30 with the shore power selector 32 each comprise three (3) wire conductors including hot or line wires (L1/L2), neutral or common wires (N1/N2), and ground wires (G1/G2). This three wire configuration may be suited, for example, in a shore power access system 10 configured to access 120 volt AC power. Those skilled in the art will appreciate that alternative configurations may be desirable, such as a three wire or four wire configuration for accessing 240 volt AC power.

As shown in the configuration of FIG. 2, the ground wires G1 and G2 are electrically connected to a galvanic isolator 62. The galvanic isolator 62 may be configured as an integrated part or component of the system 10 or may be a separate, stand-alone component. This connection may be marshaled through the shore power selector 32, as shown in FIG. 2, or the ground wires G1 and G2 may be connected directly to the galvanic isolator 62. The galvanic isolator 62 is electrically connected to a boat ground bus 64. In one example alternative configuration, the galvanic isolator 62 and the boat ground bus 64 may be integrated into the boat power distribution center 34.

In the shore power selector 32, the line wire L1 and neutral wire N1 associated with the first shore power inlet 30A are electrically connected to a first switching device 70. The line wire L2 and neutral wire N2 associated with the second shore power inlet 30B are electrically connected to a second switching device 72. The first and second switching devices 70 and 72 may be any device capable of switching, i.e., making and breaking electrical contact, to provide hot and neutral switching functionality. For example, the first and second switching devices 70 and 72 may be manually actuatable circuit breakers with over-current (trip) protection. As another example, the first and second switching devices could comprise any suitable type of mechanical switch arranged in a circuit with over-current protection devices, such as breakers or fuses. Throughout the remainder of this description of the example embodiment of FIG. 2, the first and second switching devices 70 and 72 are described as first and second circuit breakers.

The first and second circuit breakers 70 and 72 are electrically connected to the boat power distribution center 34 by known conductors 74, such as wires or cables. The conductors 74 includes a line wire (shown in solid in FIG. 2) and a neutral wire (shown in dashed lines in FIG. 2). As shown in FIG. 2, the first and second circuit breakers 70 and 72 are connected in parallel to the power distribution center 34 via the conductors 74.

The first and second circuit breakers 70 and 72 are linked to a mechanical linkage or mechanism 80, shown schematically in FIG. 2. In the example embodiment of FIG. 2, the linkage 80 is operable manually to make and break the electrical connections of the first and second circuit breakers 70 and 72. The linkage 80 may, for example, comprise a knob, handle, or lever, accessible by an operator of the boat 12. The linkage 80 may be configured to allow for manual switching between closure and trip positions of the first and second circuit breakers 70 and 72 while preventing simultaneous closure of the first and second breakers. The linkage 80 is thus manually actuatable between two positions: first circuit breaker 70 closed/second circuit breaker 72 tripped and second circuit breaker closed/first circuit breaker tripped.

From the above, it will be appreciated that the shore power selector 32 is manually actuatable via the linkage 80 to selectively direct power to the boat power distribution center from the first shore power inlet 30A or the second shore power inlet 30B. As shown in FIG. 2, the shore power access system 10 may include indicator lamps 82 and 84, such as LEDs or incandescent bulbs, for indicating the presence of shore power at the first and second shore power inlets 30A and 30B, respectively. The indicator lamps 82 and 84 thus indicate which, if any, of the shore power inlets 30 are connected to the shore power source 40 and thus may aid the boat operator in determining to which position the linkage 80 should be actuated to direct shore power to the boat power distribution center 34.

Referring to FIGS. 1 and 2, in accordance with the above description of the present invention, the shore power access system 10 allows for connecting to the shore power source 40 to the shore power inlet 30 located most conveniently given the particular scenario in which the boat 12 is moored. Once the shore power source 40 is connected to the selected shore power inlet 30, the boat operator may direct the shore power to the boat power distribution center 34 by selecting the appropriate position of the linkage 80. This position may be indicated to the operator via the indicator lamps 82 and 84.

Figure 3:
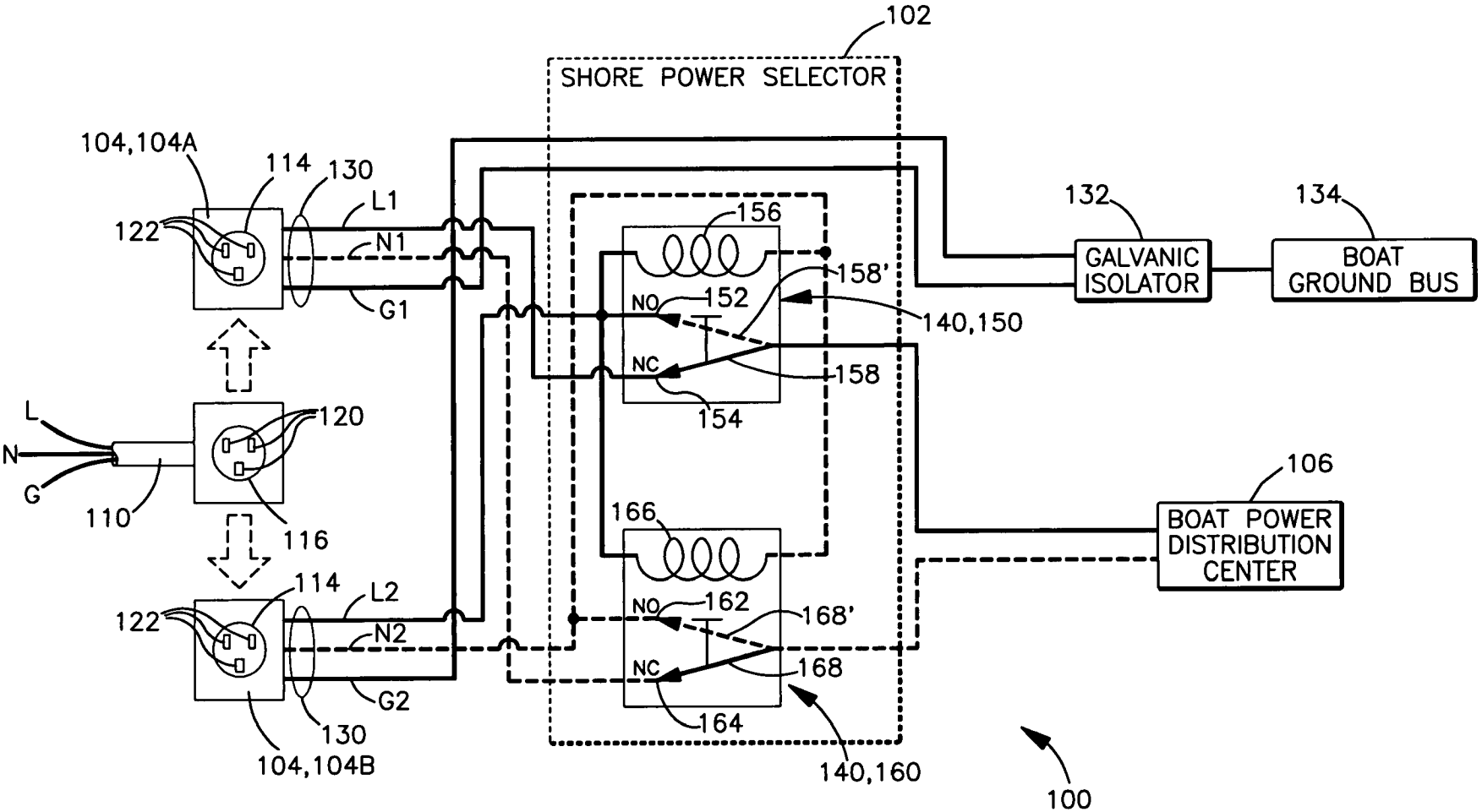
FIG. 3 is a schematic view of a shore power access system, according to a second example embodiment of the present invention.

A shore power access system 100 in accordance with a second example embodiment of the present invention is illustrated in FIG. 3. The shore power access system 100 of FIG. 3 is similar to the shore power access system 10 of FIG. 2, except that the system 100 of FIG. 3 is configured and adapted to automatically select the shore power inlet 104 to which an off-board shore power source 110, e.g., cabling, is connected.

Referring to FIG. 3, the shore power access system 100 includes a shore power selector 102 for directing shore power from shore power inlets 104 to a power distribution center 106 of the boat 12. According to the present invention, the shore power access system 100 is configured and adapted to direct shore power to the power distribution center 106 from the particular shore power inlet 104 to which the shore power source 110 is connected. The shore power access system 100 thus allows for accessing shore power through the shore power inlet 104 located most conveniently relative to the shore power cabling, given the mooring position of the boat 12.

In the embodiment of FIG. 3, shore power is distributed from the shore power source 110 to the boat power distribution center 106 via automatic operation of the shore power selector 102. The shore power access system 100 of FIG. 3 includes two shore power inlets 104 and thus may provide access to shore power at two different locations on the boat. To provide clarity in the description of the example embodiment of FIG. 3, first and second shore power inlets 104 are identified, respectively, at 104A and 104B.

The shore power inlets 104 and the shore source 110 may be fit with electrical connectors 112 in a manner similar or identical to that described above in regard to the first example embodiment of FIG. 2. The electrical connectors 112 thus may comprise a receptacles 114, associated with the shore power inlets 104, that are configured and adapted to receive and mate with plugs 116 associated with the shore source 110. In this configuration, the electrical connectors 112 may be configured and adapted to guide "female" connectors or contacts 120 of the plugs 116 onto "male" connectors or pins 122 of the receptacle 114.

The shore power inlets 104 are electrically connected to the shore power selector 102 by conductors 130, such as wires or cabling. In the example embodiment illustrated in FIG. 3, the conductors 130 connecting the shore power inlets 104 with the shore power selector 102 each comprise three (3) wire conductors including hot or line wires (L1/L2), neutral or common wires (N1/N2), and ground wires (G1/G2). This three wire configuration may be suited, for example, in a shore power access system 100 configured to access 120 volt AC power. Those skilled in the art will appreciate that alternative configurations may be desirable, such as a three wire or four wire configuration for accessing 240 volt AC power.

As shown in the configuration of FIG. 3, the ground wires G1 and G2 are electrically connected to a galvanic isolator 132. This connection may be marshaled through the shore power selector 102, as shown in FIG. 3, or the ground wires G1 and G2 may be connected directly to the galvanic isolator 132. The galvanic isolator 132 is electrically connected to a boat ground bus 134.

According to the second example embodiment, the shore power selector 102 includes automatic voltage sensing and switching circuitry or devices 140 that are configured and adapted to detect connections between the shore power source 110 and the shore power inlets 104 and direct the shore power from the shore power inlets 140 to the boat power distribution center 106. In the example embodiment illustrated in FIG. 3, the automatic voltage sensing/switching devices 140 comprise first and second relays, indicated at 150 and 160. The automatic voltage sensing/switching devices 140 may, however, comprise any device or circuit suited to detect the presence of shore power voltage at the shore power inlets 104 and switch or otherwise direct shore power from the shore power inlet at which shore power is detected to the boat power distribution center 106. For example, the automatic voltage sensing/switching devices 140 may comprise one or more relays, solid state devices, discrete electric components, controllers, or a combination of these items.

In the example embodiment of FIG. 3, the first and second relays 150 and 160 are electromechanical single pole, double throw (SPDT) relays, which are well-known commercially available devices. The first relay 150 includes a normally opened (NO) contact 152, a normally closed (NC) contact 154, a common pole 158, and a coil 156 for switching the common pole between the NO and NC contacts. The coil 156, when energized, actuates the common pole 158 from the position shown in solid lines to the position shown in dashed lines and identified at 158'. This closes the normally opened contact 152 and opens the normally closed contact 154.

The second relay 160 includes a normally opened (NO) contact 162, a normally closed (NC) contact 164, a common pole 168, and a coil 166 for switching the common pole between the NO and NC contacts. The coil 166, when energized, actuates the common pole 168 from the position shown in solid lines to the position shown in dashed lines and identified at 168'. This closes the normally opened contact 162 and opens the normally closed contact 164.

The first relay 150 is used to switch the line wires L1 and L2 of the first and second shore power inlets 104A and 104B. Line wire L1 of the first shore power inlet 104A is electrically connected to the normally closed contact 154 of the first relay 150. Line wire L2 of the second shore power inlet 104B is electrically connected to the normally opened contact 152 of the first relay 150. The common pole 158 of the first relay 150 is electrically connected to the boat power distribution center 106.

The second relay 160 is used to switch the neutral wires N1 and N2 of the first and second shore power inlets 104A and 104B. Neutral wire N1 of the first shore power inlet 104A is electrically connected to the normally closed contact 164 of the second relay 160. Neutral wire N2 of the second shore power inlet 104B is electrically connected to the normally opened contact 162 of the second relay 160. The common pole 168 of the second relay 160 is electrically connected to the boat power distribution center 106.

The coils 156 and 166 of the first and second relays 150 and 160, respectively, are electrically connected to the line wire L2 of the second shore power inlet 104B. The coils 156 and 166 are thus energized when a voltage is applied to the line wire L2 of the second shore power inlet 104B. Therefore, it will be appreciated that the coils 156 and 166 serve as voltage sensing devices, detecting when the shore power source 110 is connected to the second shore power inlet 104B by the sensing presence of voltage in the line wire L2 of the second shore power inlet.

From the above, it will be appreciated that the shore power access system 100 is configured and adapted to automatically direct shore power to the boat power distribution center 106 from the first shore power inlet 104A or the second shore power inlet 104B. Referring to FIGS. 1 and 3, in accordance with the above description of the example embodiment of FIG. 3, the shore power access system 100 allows for connecting to the shore power source 110 to the shore power inlet 104 located most conveniently given the particular scenario in which the boat 12 is moored. If the shore power source 110 is connected to the first shore power inlet 104A, the coils 158 and 168 remain de-energized and shore power is directed to the boat power distribution center 106 via the NC contacts 154 and 164. If the shore power source 110 is connected to the second shore power inlet 104B, the coils 158 and 168 are energized and move to positions shown at 158' and 168', respectively. As a result, the NO contacts 152 and 162 are closed, and shore power is thereby directed to the boat power distribution center 106.

Figure 4:
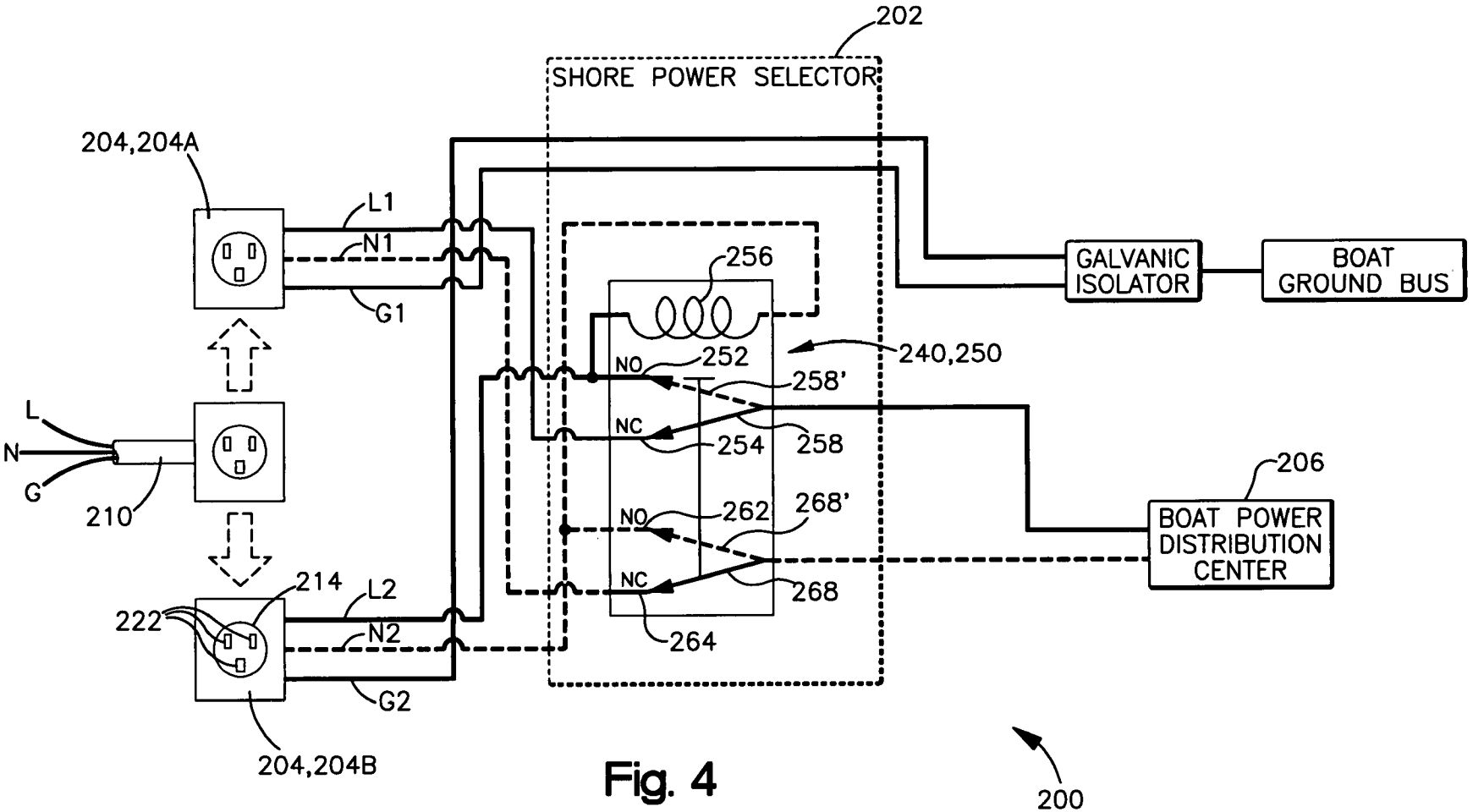
FIG. 4 is a schematic view of a shore power access system, according to a third example embodiment of the present invention.

A shore power access system 200 in accordance with a third example embodiment of the present invention is illustrated in FIG. 4. The shore power access system 200 of FIG. 4 is similar to the shore power access system 100 of FIG. 3, except that the shore power selector 202 of the system 200 of FIG. 4 includes an automatic voltage sensing/switching device 240 in the form of a singular double-pole, double-throw (DPDT) relay 250. The relay 250 automatically directs shore power from the shore power inlet 204 to which an off-board shore power source 210, e.g., cabling, is connected.

In the example embodiment of FIG. 4, the relay 250 is an electromechanical double pole, double throw (DPDT) relay, which is a well-known commercially available device. The relay 250 includes two normally opened contacts 252 and 262, two normally closed contacts 254 and 264, two common poles 258 and 268, and a coil 256 for switching the common poles between their respective NO and NC contacts. The coil 256, when energized, actuates the common poles 258 and 268 from the positions shown in solid lines to the positions shown in dashed lines and identified at 258' and 268'. This closes the NO contacts 252 and 262 and opens the NC contacts 254 and 264.

The NO contact 252, NC contact 254, and common pole 258 are used to switch the line wires L1 and L2 of the first and second shore power inlets 204A and 204B. Line wire L1 of the first shore power inlet 204A is electrically connected to the NC contact 254. Line wire L2 of the second shore power inlet 204B is electrically connected to the NO contact 252. The common pole 258 is electrically connected to the boat power distribution center 206.

The NO contact 262, NC contact 264, and common pole 268 are used to switch the neutral wires N1 and N2 of the first and second shore power inlets 204A and 204B. Neutral wire N1 of the first shore power inlet 204A is electrically connected to the NC contact 264. Neutral wire N2 of the second shore power inlet 204B is electrically connected to the NO contact 262. The common pole 268 is electrically connected to the boat power distribution center 206.

The coil 256 is electrically connected to the line wire L2 of the second shore power inlet 204B. The coil 256 is thus energized when a voltage is applied to the line wire L2 of the second shore power inlet 204B. Therefore, it will be appreciated that the coil 256 serves as a voltage sensing device, detecting when the shore power source 210 is connected to the second shore power inlet 204B by sensing the presence of voltage in the line wire L2 of the second shore power inlet.

From the above, it will be appreciated that the shore power access system 200 is configured and adapted to automatically direct shore power to the boat power distribution center 206 from the first shore power inlet 204A or the second shore power inlet 204B. Referring to FIGS. 1 and 4, in accordance with the above description of the example embodiment of FIG. 4, the shore power access system 200 allows for connecting to the shore power source 210 to the shore power inlet 204 located most conveniently given the particular scenario in which the boat 12 is moored. If the shore power source 210 is connected to the first shore power inlet 204A, the coil 258 remains de-energized and shore power is directed to the boat power distribution center 206 via the NC contacts 254 and 264. If the shore power source 210 is connected to the second shore power inlet 204B, the coil 258 is energized, the NO contacts 252 and 262 are closed, and shore power is thereby directed to the boat power distribution center 206.

From the above, it will be appreciated that the shore power access system of the present invention allows for great flexibility in connecting to shore power at a dock or other mooring station. This, in turn, allows for greater flexibility in positioning the boat at a desired orientation conducive to issues such as privacy, maneuverability and view. For example, it may be desirable to dock the boat with the bow into the dock to help prevent others from viewing inside the aft cabin through the stern. In this event, the present invention may facilitate convenient access to the shore power source.

From the above description of the invention, those skilled in the art will perceive improvements, changes and modifications. Such improvements, changes and modifications within the skill of the art are intended to be covered by the appended claims.

I claim:

1. A shore power access system for directing shore power to a power distribution center of a boat, the shore power access system comprising:

at least two shore power inlets mountable onboard the boat, the shore power inlets being connectable with a source of shore power located off-board the boat to receive shore power from the off-board source;

an actuatable switching means for establishing an electrical connection between one of the shore power inlets and the boat power distribution center, the switching means being operatively connectable to the shore power inlets and to the boat power distribution center, the switching means having multiple switch conditions, the switching means in every switch condition electrically connecting one of the shore power inlets to the power distribution center and electrically isolating the remaining shore power inlets from the power distribution center; and actuating means for actuating the switching means, the actuating means being actuatable in response to a connection of the shore power source to any one of the shore power inlets to actuate the switching means to the switch condition directing shore power from the shore power inlet where the connection was made to the power distribution center.

2. The shore power access system recited in claim 1, wherein the actuating means comprises a mechanism for manually actuating the switching means in response to the connection of the shore power source to the shore power inlet.

3. The shore power access system recited in claim 2, further comprising indicator means for indicating the presence of a connection between the off-board source of shore power and one of the shore power inlets, the indicator means dictating a position to which the mechanism may be placed manually to direct shore power to the boat power distribution center.

4. The shore power access system recited in claim 2, wherein the switching means comprises a breaker operative to make and break electrical connections between the shore power inlets and the boat power distribution center, the breaker being actuatable manually to the multiple switch conditions.

5. The shore power access system recited in claim 1, wherein the actuating means automatically senses a voltage at the shore power inlet where the connection was made and automatically actuates the switching means in response to the sensed voltage to actuate the switching means to the switch condition directing shore power to the boat power distribution center from the shore power inlet at which the voltage is sensed.

6. The shore power access system recited in claim 5, wherein the actuating means comprises a relay.

7. The shore power access system recited in claim 6, wherein the relay comprises a coil for automatically sensing the presence of shore power at the shore power inlet where the connection was made, and at least one relay contact associated with each shore power inlet, the relay contacts being actuatable upon energizing the coil to direct the shore power from the shore power inlet where the connection was made to the power distribution center.

8. The shore power access system recited in claim 7, wherein the coil is operatively connected to a line wire of one of the shore power inlets, the coil being energizable upon the one of the shore power inlets being connected to the off-board source of shore power to actuate the relay contacts to direct the shore power from the one of the shore power inlets to the boat power distribution center.

9. The shore power access system recited in claim 6, wherein the switching means comprises a unitary double pole, double throw relay.

10. The shore power access system recited in claim 6, wherein the switching means comprises multiple single pole, double throw relays having coils wired in series.

11. The shore power access system recited in claim 1, wherein the shore power inlets comprise a first shore power inlet located on or near a port side of the boat and a second shore power inlet located on or near a starboard side of the boat.

12. The shore power access system recited in claim 1, wherein the shore power inlets comprise a first shore power inlet located at or near a mid-ship position on the boat and a second shore power inlet located at or near a stern of the boat.

13. The shore power access system recited in claim 1, wherein the switching means comprises a single manual switch actuatable manually to each of the multiple switch conditions.

14. A shore power access system comprising:

a first shore power inlet comprising a first hot wire, a first neutral wire, and a first ground wire;

a second shore power inlet comprising a second hot wire, a second neutral wire, and a second ground wire;

a ground bus having an electrical connection with the first ground wire and the second ground wire;

a boat power distribution center;

hot wire switching means operatively connected with the first and second hot wires and the boat power distribution center, the hot wire switching means being actuatable to a first condition making a connection between the first hot wire and the boat power distribution center and breaking a connection between the second hot wire and the boat power distribution center, the hot wire switching means being actuatable to a second condition making the connection between the second hot wire and the boat power distribution center and breaking the connection between the first hot wire and the boat power distribution center;

neutral wire switching means operatively connected with the first and second neutral wires and the boat power distribution center, the neutral wire switching means being actuatable to a first condition making a connection between the first neutral wire and the boat power distribution center and breaking a connection between the second neutral wire and the boat power distribution center, the neutral wire switching means being actuatable to a second condition making the connection between the second neutral wire and the boat power distribution center and breaking the connection between the first neutral wire and the boat power distribution center; and actuating means for actuating the hot wire switching means and the neutral wire switching means to their first conditions in response to a connection of the shore power source to the first shore power inlet, the actuating means actuating the hot wire switching means and the neutral wire switching means to their second conditions in response to a connection of the shore power source to the second shore power inlet, the actuating means being configured to prevent one of the hot wire switching means and the neutral wire switching means from being actuated to the first condition while the other of the hot wire switching means and the neutral wire switching means is actuated to the second condition.

15. A shore power access system for directing shore power to a power distribution center of a boat, the shore power access system comprising:

a port side shore power inlet mounted on a port side of the boat, the port side shore power inlet being connectable with a source of shore power located off-board the boat to receive shore power from the off-board source;

a starboard side shore power inlet mounted on a starboard side of the boat, the port side shore power inlet being connectable with a source of shore power located off-board the boat to receive shore power from the off-board source;

a switch having a first condition and a second condition, the switch when in the first condition establishing an electrical connection between the port shore power inlet and the boat power distribution center and blocking an electrical connection between the starboard shore power inlet and the boat power distribution center, the switch when in the second condition establishing an electrical connection between the starboard shore power inlet and the boat power distribution center and blocking an electrical connection between the port shore power inlet and the boat power distribution center, the switch being adapted to actuate automatically to the first condition in response to shore power being connected to the port side shore power inlet, the switch being adapted to actuate automatically to the second condition in response to shore power being connected to the starboard side shore power inlet.

16. The shore power access system recited in claim 15, wherein the switch comprises a relay comprising a coil energizable to actuate the relay, the coil being operatively connected to one of the port side and starboard side shore power inlets so as to be energized upon an electrical connection between the one of the port side and starboard side shore power inlets and the source of shore power.

* * * * *